US012018684B2

(12) United States Patent
Nagahara

(10) Patent No.: US 12,018,684 B2
(45) **Date of Patent: *Jun. 25, 2024**

(54) COMPRESSION MECHANISM HOUSING FOR A COMPRESSOR

(71) Applicant: DAIKIN INDUSTRIES, LTD., Osaka (JP)

(72) Inventor: Kenji Nagahara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 342 days.

This patent is subject to a terminal disclaimer.

(21) Appl. No.: 17/523,626

(22) Filed: Nov. 10, 2021

(65) Prior Publication Data

US 2022/0065251 A1 Mar. 3, 2022

Related U.S. Application Data

(63) Continuation of application No. PCT/JP2020/016605, filed on Apr. 15, 2020.

(30) Foreign Application Priority Data

May 21, 2019 (JP) ..... 2019-094995

(51) Int. Cl.

| | |
|---|---|
| ***F04C 23/00*** | (2006.01) |
| ***F01C 21/10*** | (2006.01) |
| ***F04C 18/02*** | (2006.01) |
| ***F04C 29/00*** | (2006.01) |
| ***F04C 29/02*** | (2006.01) |

(52) U.S. Cl.

CPC .... *F04C 18/0215* (2013.01); *F04C 2230/231* (2013.01); *F04C 2240/30* (2013.01)

(58) Field of Classification Search

CPC ..... F04C 18/0215; F04C 18/0253; F04C 23/008; F04C 29/0057; F04C 2230/231; F04C 29/02; F01C 21/10

See application file for complete search history.

(56) References Cited

U.S. PATENT DOCUMENTS

| | | | | |
|---|---|---|---|---|
| 5,547,355 | A | 8/1996 | Watanabe et al. | |
| 7,967,579 | B2 | 6/2011 | Higuchi et al. | |
| 2006/0127260 | A1* | 6/2006 | Um | F04C 23/008 418/55.1 |

FOREIGN PATENT DOCUMENTS

| | | | |
|---|---|---|---|
| CN | 101153593 | A | 4/2008 |
| CN | 104963866 | A | 10/2015 |
| EP | 2 138 722 | A1 | 12/2009 |
| EP | 2 330 301 | A1 | 6/2011 |
| JP | 60-201095 | A | 10/1985 |

(Continued)

OTHER PUBLICATIONS

English translation of JP-2017025762 by PE2E May 27, 2023.*

(Continued)

*Primary Examiner* — Deming Wan

(74) *Attorney, Agent, or Firm* — Global IP Counselors, LLP

(57) ABSTRACT

A compressor including a casing having a cylindrical shape, and a compression mechanism housed in the casing. The compression mechanism having a housing including a pressing portion pressed against the casing and a weld portion welded to the casing. At least part of the pressing portion and at least part of the weld portion being arranged side by side in a circumferential direction of the casing.

5 Claims, 6 Drawing Sheets

(56) References Cited

FOREIGN PATENT DOCUMENTS

| | | | | | |
|---|---|---|---|---|---|
| JP | 7-217554 | A | | 8/1995 | |
| JP | 9-108832 | A | | 4/1997 | |
| JP | 2009-97417 | A | | 5/2009 | |
| JP | 2010-265845 | A | | 11/2010 | |
| JP | 2014-101753 | A | | 6/2014 | |
| JP | 2017-25762 | A | | 2/2017 | |
| JP | 2017025762 | A | * | 2/2017 | ..... F04C 29/02 |

OTHER PUBLICATIONS

International Search Report of corresponding PCT Application No. PCT/JP2020/016605 dated Jul. 7, 2020.
International Preliminary Report of corresponding PCT Application No. PCT/JP2020/016605 dated Dec. 2, 2021.
European Search Report of corresponding EP Application No. 20 80 9045.6 dated Jun. 29, 2022.

* cited by examiner

COMPRESSION MECHANISM HOUSING FOR A COMPRESSOR

CROSS-REFERENCE TO RELATED APPLICATIONS

This is a continuation of International Application No. PCT/JP2020/016605 filed on Apr. 15, 2020, which claims priority to Japanese Patent Application No. 2019-094995, filed on May 21, 2019. The entire disclosures of these applications are incorporated by reference herein.

BACKGROUND

Field of Invention

The present disclosure relates to a compressor.

Background Information

Compressors including a casing and a housing fixed to the casing by pressing and welding have been known (see, e.g., Japanese Unexamined Patent Publication No. 2017-25762). A load is applied between the casing and the housing during compression of a fluid. This load is supported by the fixed portions.

SUMMARY

A first aspect of the present disclosure is directed to a compressor including a casing having a cylindrical shape, and a compression mechanism housed in the casing. The compression mechanism having a housing including a pressing portion pressed against the casing and a weld portion welded to the casing. At least part of the pressing portion and at least part of the weld portion being arranged side by side in a circumferential direction of the casing.

DETAILED DESCRIPTION OF EMBODIMENT(S)

First Embodiment

A first embodiment will be described below. A compressor (1) of the present embodiment is a scroll compressor. The compressor (1) is not limited to the scroll compressor.

Figure 1:
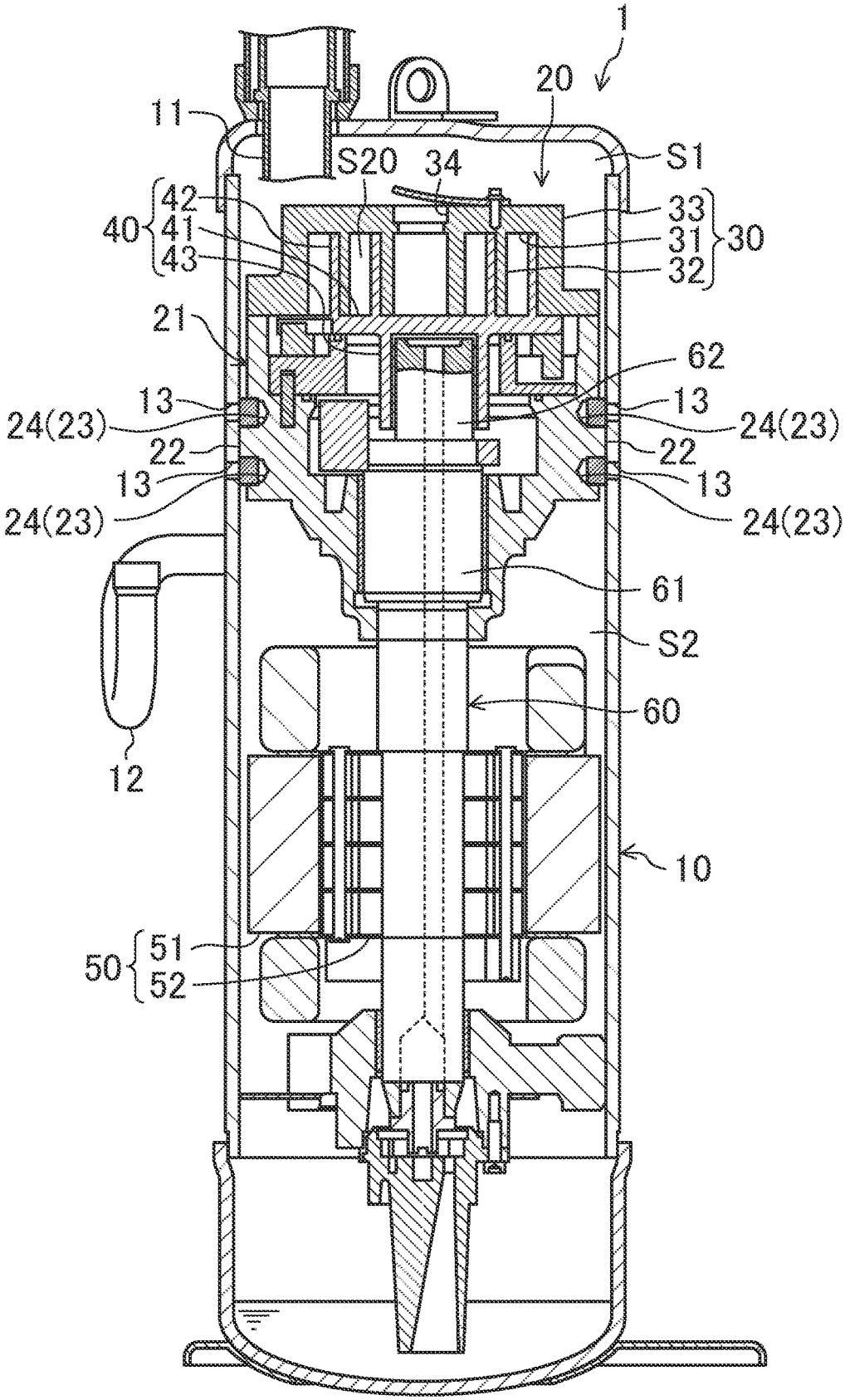
FIG. 1 is a vertical cross-sectional view illustrating a configuration of a compressor according to a first embodiment.
Figure 2:
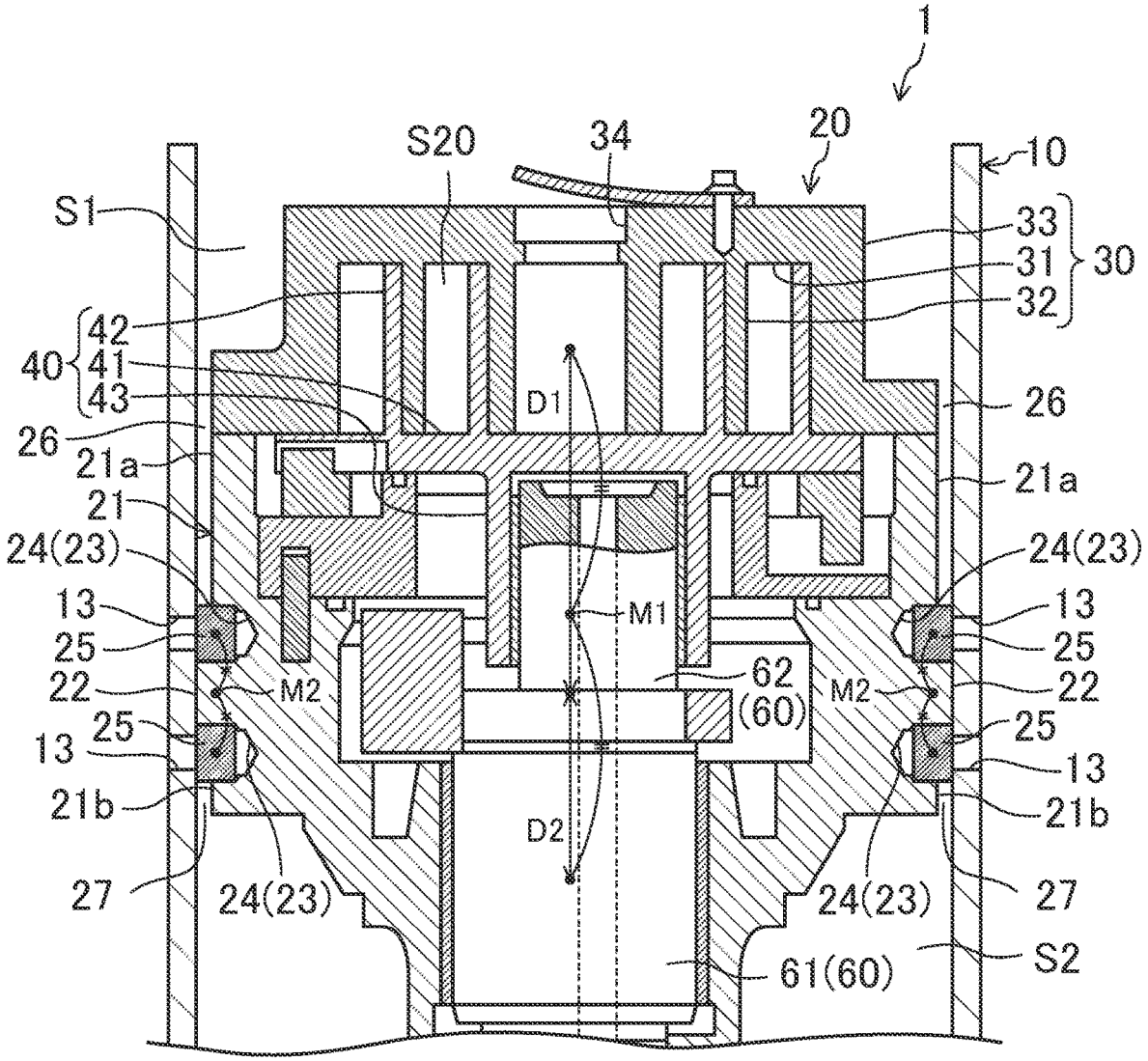
FIG. 2 is a vertical cross-sectional view illustrating an essential portion of the compressor according to the first embodiment.

As illustrated in FIGS. 1 and 2, the compressor (1) is provided in, for example, a vapor compression refrigerant circuit (not shown), and compresses a refrigerant (an example of a fluid). For example, in such a refrigerant circuit, the refrigerant compressed in the compressor (1) condenses in a condenser, has its pressure decreased in a decompression mechanism, evaporates in an evaporator, and is then sucked into the compressor (1).

The compressor (1) includes a casing (10), a compression mechanism (20), an electric motor (50), and a drive shaft (60).

The casing (10) is in the shape of a vertically long cylinder with both ends closed. The casing (10) houses therein the compression mechanism (20) and the electric motor (50) sequentially arranged from top. The drive shaft (60) extending in the casing (10) in an axial direction (vertical direction) connects the compression mechanism (20) and the electric motor (50).

The casing (10) is provided with a suction pipe (11) and a discharge pipe (12). The suction pipe (11) passes through an upper portion of the casing (10) in the axial direction so as to be connected to the compression mechanism (20). The suction pipe (11) introduces a low-pressure fluid (for example, a gas refrigerant) into the compression mechanism (20). The discharge pipe (12) passes through the barrel of the casing (10) in a radial direction to communicate with the internal space of the casing (10). The discharge pipe (12) introduces a high-pressure fluid in the casing (10) out of the casing (10).

The compression mechanism (20) is housed in the casing (10). The compression mechanism (20) is configured to compress the fluid introduced through the suction pipe (11) and discharge the compressed fluid into the casing (10). The configuration of the compression mechanism (20) will be described in detail.

The electric motor (50) is housed in the casing (10), and is disposed below the compression mechanism (20). The electric motor (50) includes a stator (51) and a rotor (52). The stator (51) is substantially in the shape of a cylinder, and is fixed to the casing (10). The rotor (52) is inserted in the stator (51) to be rotatable on the inner periphery of the stator (51). The drive shaft (60) is inserted through, and fixed to, the inner circumference of the rotor (52).

The drive shaft (60) has a main shaft portion (61) and an eccentric shaft portion (62). The main shaft portion (61) extends in the axial direction (vertical direction) of the casing (10). The eccentric shaft portion (62) is provided at an upper end of the main shaft portion (61). The outer diameter of the eccentric shaft portion (62) is smaller than that of the main shaft portion (61). The eccentric shaft portion (62) has an axis decentered by a predetermined distance with respect to the axis of the main shaft portion (61).

Next, the configuration of the compression mechanism (20) will be described with reference to FIGS. 1 to 4.

As illustrated in FIGS. 1 and 2, the compression mechanism (20) includes a housing (21), a fixed scroll (30), and a movable scroll (40). The housing (21) is provided in the casing (10). The fixed scroll (30) is fixed to the housing (21). The movable scroll (40) is disposed between the housing (21) and the fixed scroll (30). The movable scroll (40) is configured to mesh with the fixed scroll (30) and rotate eccentrically relative to the fixed scroll (30).

The housing (21) is fixed in the casing (10), and partitions the internal space of the casing (10) into two spaces in the axial direction. One of the spaces above the housing (21) constitutes a first space (51), and the other space below the housing (21) constitutes a second space (S2).

Figure 3:
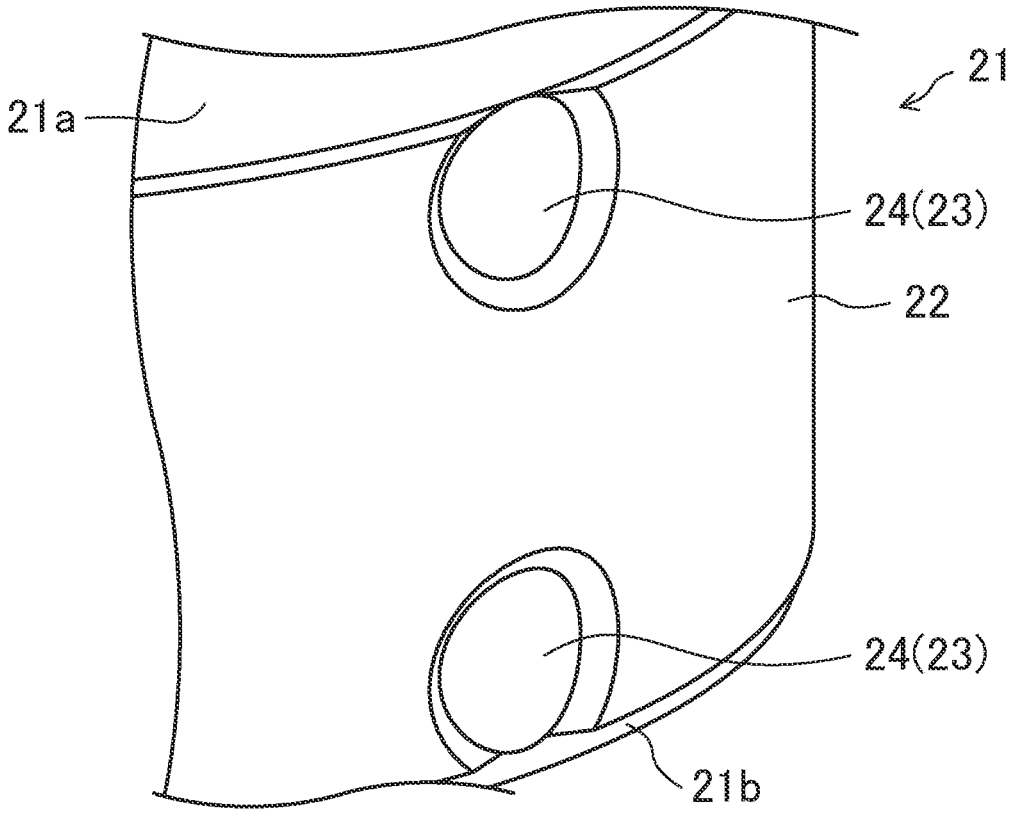
FIG. 3 is a perspective view illustrating an essential portion of a housing according to the first embodiment.

The housing (21) is fixed to the inner peripheral surface of the casing (10). As illustrated in FIG. 3, the housing (21)

includes a pressing portion (22) and weld portions (23). The pressing portion (22) is pressed against the casing (10). The weld portions (23) are welded to the casing (10).

The pressing portion (22) is configured as an outer peripheral surface of the housing (21). The pressing portion (22) has a smaller axial length (vertical length) than the housing (21). The pressing portion (22) is pressed against and fixed to the barrel of the casing (10).

The weld portions (23) are configured as recesses (24) formed on the outer peripheral surface of the housing (21). Welding pins (25) are provided in the recesses (24). The welding pins (25) melt when welded via welding through holes (13) formed in the casing (10), thereby fixing the housing (21) and the casing (10) together.

Figure 4:
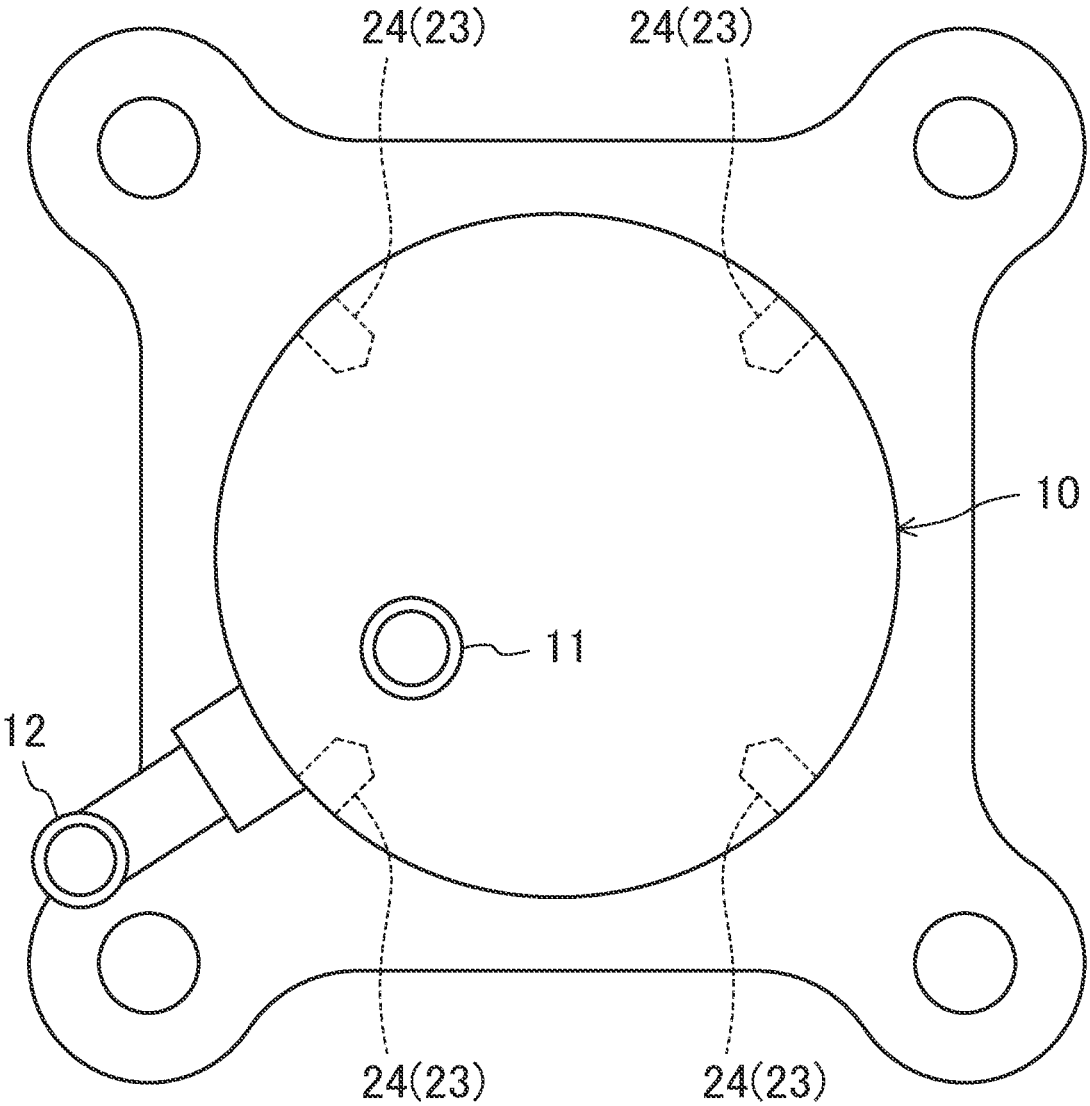
FIG. 4 is a schematic plan view illustrating the compressor according to the first embodiment.

Two or more (two in this example) weld portions (23) are arranged in the axial direction of the casing (10) (FIG. 2). Two or more (four in this example) weld portions (23) are arranged in the circumferential direction of the casing (10) (FIG. 4).

A first gap (26) is formed between the outer peripheral surfaces of the housing (21) and the fixed scroll (30) and the inner peripheral surface of the casing (10) above the upper ones of the weld portions (23) (the recesses (24)). A portion of the housing (21) above the pressing portion (22) is a smaller diameter portion (21*a*) having a smaller diameter than the pressing portion (22). The outer peripheral surface of the fixed scroll (30) is substantially flush with the outer peripheral surface of the smaller diameter portion (21*a*). The first gap (26) is formed between the inner peripheral surface of the casing (10), and the outer peripheral surface of the fixed scroll (30) and the smaller diameter portion (21*a*). The first gap (26) allows the upper ones of the weld portions (23) to communicate with the first space (S1). The first gap (26) constitutes a communication gap.

A second gap (27) is formed between the outer peripheral surface of the housing (21) and the inner peripheral surface of the casing (10) below the lower ones of the weld portions (23) (the recesses (24)). A portion of the housing (21) below the pressing portion (22) is a smaller diameter portion (21*b*) having a smaller diameter than the pressing portion (22). The second gap (27) is formed between the smaller diameter portion (21*b*) and the inner peripheral surface of the casing (10). The second gap (27) allows the lower ones of the weld portions (23) to communicate with the second space (S2). The second gap (27) constitutes a communication gap.

As illustrated in FIGS. 2 and 3, at least part of the pressing portion (22) and at least part of the weld portion (23) (the recess (24)) are arranged side by side in the circumferential direction of the casing (10). At least part of the pressing portion (22) and at least part of the weld portion (23) (the recess (24)) are arranged so as to be close to each other in the circumferential direction of the casing (10). At least part of the pressing portion (22) and at least part of the weld portion (23) (the recess (24)) are arranged so as to substantially adjoin each other in the circumferential direction of the casing (10).

At least part of the pressing portion (22) and at least part of the weld portion (23) (the recess (24)) are arranged side by side in the axial direction of the casing (10). At least part of the pressing portion (22) and at least part of the weld portion (23) (the recess (24)) are arranged so as to be close to each other in the axial direction of the casing (10). At least part of the pressing portion (22) and at least part of the weld portion (23) (the recess (24)) are arranged so as to substantially adjoin each other in the axial direction of the casing (10).

Thus, at least part of the pressing portion (22) and at least part of the weld portion (23) (the recess (24)) are arranged side by side in the circumferential and axial directions of the casing (10). At least part of the pressing portion (22) and at least part of the weld portion (23) (the recess (24)) are arranged so as to be close to each other in the circumferential and axial directions of the casing (10). At least part of the pressing portion (22) and at least part of the weld portion (23) (the recess (24)) are arranged so as to substantially adjoin each other in the circumferential and axial directions of the casing (10). Thus, the casing (10) and the housing (21) are more firmly fixed to each other.

The fixed scroll (30) is disposed on one axial side (upper side in this example) of the housing (21). The fixed scroll (30) includes a fixed end plate (31), a fixed wrap (32), and an outer peripheral wall (33).

The fixed end plate (31) has a substantially circular plate shape. The fixed wrap (32) is formed in the shape of a spiral wall that shows an involute curve, and protrudes from a front face (lower face in this example) of the fixed end plate (31). The outer peripheral wall (33) surrounds the outer periphery of the fixed wrap (32), and protrudes from the front face of the fixed end plate (31). A distal end face (lower end face in this example) of the fixed wrap (32) is substantially flush with a distal end face of the outer peripheral wall (33).

The outer peripheral wall (33) of the fixed scroll (30) has a suction port (not shown). The suction port is connected to a downstream end of the suction pipe (11). The fixed end plate (31) of the fixed scroll (30) has, at its center, a discharge port (34) penetrating the fixed end plate (31) in a thickness direction.

The movable scroll (40) includes a movable end plate (41), a movable wrap (42), and a boss (43).

The movable end plate (41) has a substantially circular plate shape. The movable wrap (42) is formed in the shape of a spiral wall that shows an involute curve, and protrudes from a front face (upper face in this example) of the movable end plate (41). The boss (43) is formed in a cylindrical shape, and is positioned at a center portion of a back face (lower face in this example) of the movable end plate (41). The movable wrap (42) of the movable scroll (40) meshes with the fixed wrap (32) of the fixed scroll (30).

This configuration provides a compression chamber (S20) between the fixed scroll (30) and the movable scroll (40). The compression chamber (S20) is a space for compressing a fluid. The compression chamber (S20) is configured to compress a fluid sucked from the suction pipe (11) through the suction port, and discharge the compressed fluid through the discharge port (34).

The compression mechanism (20) is configured to generate a compressive load on the compression chamber (S20) and a bearing load on the main shaft portion (61) of the drive shaft (60) during operation, i.e., while the movable scroll (40) rotates eccentrically relative to the fixed scroll (30). The compressive load and the bearing load are out of phase with each other in the direction of rotation. Typically, the compressive load is smaller than the bearing load, and both are about 180° out of phase with each other. The compressive load is an example of a first load, and the bearing load is an example of a second load.

As illustrated in FIG. 2, a midpoint (M2) between two of the weld portions (23) (the recesses (24)) arranged in the axial direction of the casing (10) is closer to a position where the bearing load is generated than a midpoint (M1) between a position where the compressive load is generated and the position where the bearing load is generated. More specifically, the upper one of the two weld portions (23) is located above an internally dividing point in an inverse ratio between the compressive load and the bearing load, and the lower one of the two weld portions (23) is located below the internally dividing point in the inverse ratio. When the ratio of the magnitude of the compressive load to the magnitude of the bearing load is a:b, a relation D1×a=D2×b is established where D1 represents an axial distance between the internally dividing point in the inverse ratio and the axial center of the compression chamber (S20), and D2 represents an axial distance between the internally dividing point in the inverse ratio and the axial center of the main shaft portion (61).

Advantages of First Embodiment

The compressor (1) of the present embodiment includes: a casing (10) having a cylindrical shape; and a compression mechanism (20) housed in the casing (10), wherein the compression mechanism (20) has a housing (21) including a pressing portion (22) pressed against the casing (10) and a weld portion (23) welded to the casing (10), and at least part of the pressing portion (22) and at least part of the weld portion (23) are arranged side by side in a circumferential direction of the casing (10). Thus, the at least part of the pressing portion (22) and the at least part of the weld portion (23) are arranged side by side in the circumferential direction of the casing (10). This configuration can downsize the housing (21) in the axial direction of the casing (10), and in turn, can downsize the compressor (1), compared to a configuration in which the pressing portion (22) and the weld portion (23) are arranged side by side in the axial direction of the casing (10).

The compressor (1) of the present embodiment includes a first gap (26) and a second gap (27) that allow the weld portion (23) to communicate with an internal space of the casing (10). Thus, the weld portion (23) and the internal space of the casing (10) communicate with each other through the first gap (26) and the second gap (27). This configuration allows welding gas to be released into the internal space of the casing (10) through the first gap (26) and the second gap (27) when the housing (21) is welded to the casing (10), thereby reducing poor welding.

In the compressor (1) of the present embodiment, the weld portion (23) is configured a recess (24) formed in the housing (21), and the communication passage (26 to 29) is configured as the first gap (26) and the second gap (27) formed between the casing (10) and the housing (21) and allowing the recess (24) to communicate with the internal space of the casing (10). This simple structure including the recess (24), the first gap (26), and the second gap (27) can reduce poor welding.

In the compressor (1) of the present embodiment, the weld portion (23) includes a plurality of weld portions (23) arranged in the circumferential direction of the casing (10). Thus, the compressor is more able to withstand the load generated during fluid compression.

In the compressor (1) of the present embodiment, the weld portion (23) includes a plurality of weld portions (23) arranged in an axial direction of the casing (10). Thus, the compressor is more able to withstand the load generated during fluid compression.

In the compressor (1) of the present embodiment, the compression mechanism (20) is configured to generate a compressive load and a bearing load larger than the compressive load at positions apart from each other in the axial direction during operation of the compression mechanism (20), and the plurality of weld portions (23) include two of the weld portions (23), a midpoint (M2) of the two weld portions (23) being closer in the axial direction to a position where the bearing load is generated than a midpoint (M1) between a position where the compressive load is generated and the position where the bearing load is generated. In this configuration, the compressive load and the bearing load produce a moment at a position closer to the position where the bearing load is generated than the midpoint (M1) between the positions where the compressive load and the bearing load are generated. The moment can be appropriately supported by the two weld portions (23).

Second Embodiment

A second embodiment will be described below. A compressor (1) of the present embodiment is different from the compressor of the first embodiment in the configuration of communication passages. Thus, differences from the first embodiment will be mainly described below.

Figure 5:
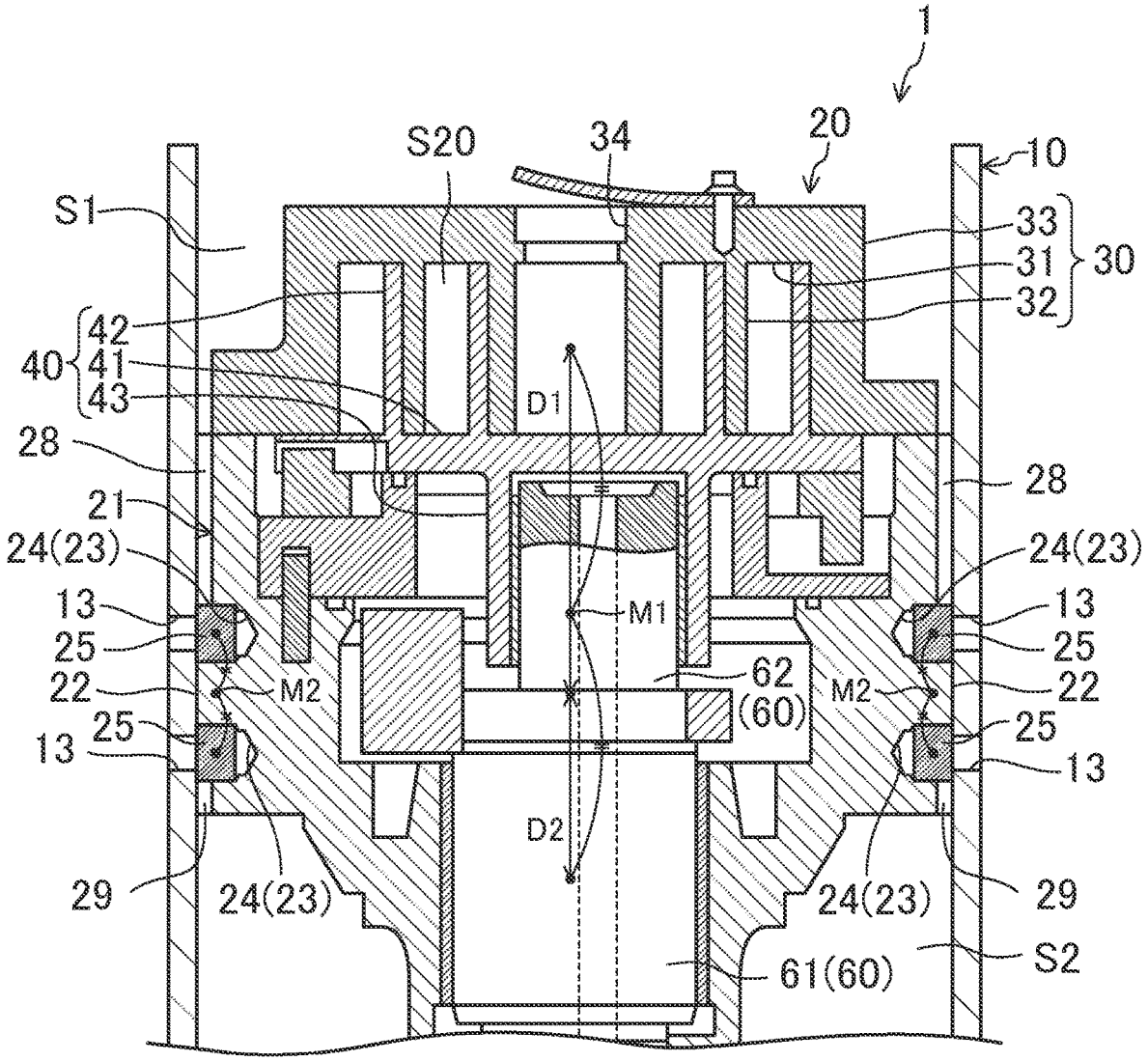
FIG. 5 is a vertical cross-sectional view illustrating an essential portion of a compressor according to a second embodiment.
Figure 6:
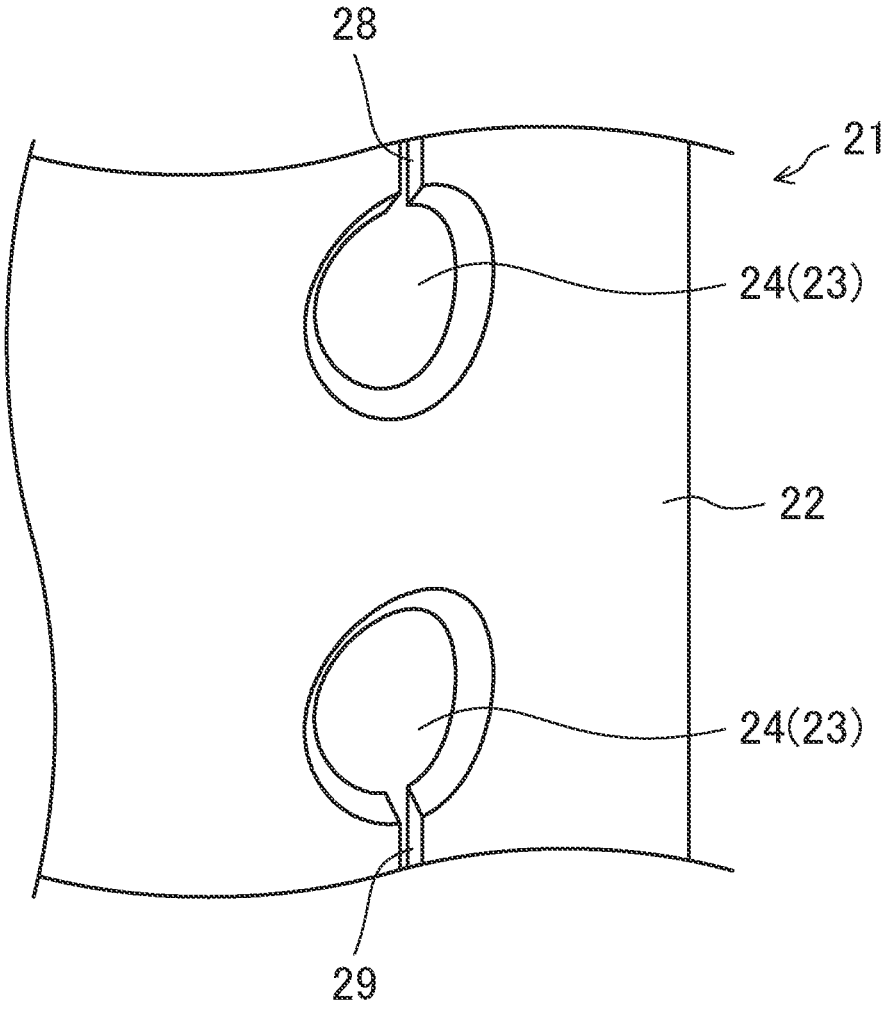
FIG. 6 is a perspective view illustrating an essential portion of a housing according to the second embodiment.

As illustrated in FIGS. 5 and 6, the communication passages of the present embodiment are configured as first communication grooves (28) and second communication grooves (29) formed in the housing (21).

The first communication grooves (28) extend vertically in the outer peripheral surfaces of the housing (21) and the fixed scroll (30), and allow the upper ones of the weld portions (23) (the recesses (24)) to communicate with the first space (S1). The second communication grooves (29) extend vertically in the outer peripheral surface of the housing (21), and allow the lower ones of the weld portions (23) (the recesses (24)) to communicate with the second space (S2). Each of the first communication grooves (28) and the second communication grooves (29) constitutes the communication passage.

In a preferred embodiment, the first communication grooves (28) and the second communication grooves (29) are provided on a one-to-one basis for two or more (four in this example) weld portions (23) arranged side by side in the circumferential direction of the casing (10). The shape and arrangement of the first and second communication grooves (28, 29) may be optionally designed as long as the weld portions (23) communicate with the internal space of the casing (10).

Advantages of Second Embodiment

The present embodiment also achieves the same advantages and effects as those of the first embodiment.

In the compressor (1) of the present embodiment, the weld portion (23) is configured a recess (24) formed in the housing (21), and the communication passage (26 to 29) is configured as the first communication groove (28) and the second communication groove (29) formed in the housing (21) and allowing the recess (24) to communicate with the internal space of the casing (10). Thus, welding gas is released from the recesses (24) into the internal space of the casing (10) through the first and second communication grooves (28, 29) when the housing (21) is welded to the casing (10). This simple structure including the recesses (24), the first communication grooves (28), and the second communication grooves (29) can reduce poor welding.

OTHER EMBODIMENTS

The foregoing embodiment may be modified as follows.

For example, any number of weld portions (23) may be arranged in the axial direction of the casing (10). If three or more weld portions (23) are provided, the three or more weld portions (23) preferably include two weld portions (23), a midpoint (M2) of which is closer to a position where the bearing load is generated than a midpoint (M1) between a position where the compressive load is generated and the position where the bearing load is generated.

For example, any number of weld portions (23) may be arranged in the circumferential direction of the casing (10).

While embodiments and variations have been described above, it will be understood that various modifications in form and detail may be made without departing from the spirit and scope of the present disclosure as set forth in the appended claims. The foregoing embodiments and variations thereof may be combined and replaced with each other without deteriorating the intended functions of the present disclosure.

As can be seen from the foregoing description, the present disclosure is useful for a compressor.

The invention claimed is:

1. A compressor, comprising:

a casing having a cylindrical shape;

a compression mechanism housed in the casing;

the compression mechanism having a housing including a pressing portion pressed against the casing and a weld portion welded to the casing, and at least part of the pressing portion and at least part of the weld portion being arranged side by side in a circumferential direction of the casing; and a communication passage allowing the weld portion to communicate with an internal space of the casing.

2. The compressor of claim 1, wherein the weld portion is configured as a recess formed in the housing, and the communication passage is configured as a communication gap formed between the casing and the housing, and the communication passage allows the recess to communicate with the internal space of the casing.

3. The compressor of claim 1, wherein the weld portion includes a plurality of weld portions arranged in the circumferential direction of the casing.

4. The compressor of claim 1, wherein the weld portion includes a plurality of weld portions arranged in an axial direction of the casing.

5. The compressor of claim 4, wherein the compression mechanism is configured to generate a first load and a second load larger than the first load at positions apart from each other in the axial direction during operation of the compression mechanism, and the plurality of weld portions include two weld portions, a midpoint of the two weld portions being closer in the axial direction to a position where the second load is generated than a midpoint between a position where the first load is generated and the position where the second load is generated.

* * * * *